US006234486B1

(12) United States Patent
Wallice

(10) Patent No.: US 6,234,486 B1
(45) Date of Patent: May 22, 2001

(54) WORD CARD GAME

(76) Inventor: Patricia Anne Wallice, 3710 27th Pl. West, No. 203, Seattle, WA (US) 98199

( * ) Notice: Subject to any disclaimer, the term of this patent is extended or adjusted under 35 U.S.C. 154(b) by 0 days.

(21) Appl. No.: 09/572,063

(22) Filed: May 17, 2000

(51) Int. Cl.[7] ..... A63F 1/00
(52) U.S. Cl. ..... 273/299; 273/272; 273/292
(58) Field of Search ..... 273/292, 299, 273/272, 302, 308, 243, 249, 250, 251, 252, 253, 254, 429, 230

(56) References Cited

U.S. PATENT DOCUMENTS

| | | | | |
|---|---|---|---|---|
| 4,333,656 | | 6/1982 | Sommer | 273/299 |
| 4,428,582 | * | 1/1984 | Smith | 273/296 |
| 4,773,651 | * | 9/1988 | Papapavlou | 273/249 |
| 4,775,157 | * | 10/1988 | Armstrong | 273/299 |
| 4,826,175 | * | 5/1989 | Quatrino | 273/299 |
| 4,877,255 | * | 10/1989 | von Braunhut | 273/299 |
| 5,014,996 | * | 5/1991 | von Braunhut | 273/299 |
| 5,409,237 | * | 4/1995 | Marcley et al. | 273/299 |
| 5,417,432 | | 5/1995 | Dwyer | 273/299 |
| 5,524,899 | * | 6/1996 | Haqendorn | 273/299 |
| 5,906,492 | * | 5/1999 | Putterman | 434/169 |

OTHER PUBLICATIONS

Letras™ game 1998 Letras Grand Isle Games, Inc.
Quiddler™ game 1998 Quiddler Set Enterprises, Inc.

* cited by examiner

*Primary Examiner*—Jeanette Chapman
*Assistant Examiner*—Zelalem Eshete

(57) ABSTRACT

A word-forming card game that does not feature points comprising a deck of cards marked with letters of the alphabet and method of play. Players are dealt seven cards which they hold "hand" style and keep private throughout game. Each player, in turn, has the opportunity to change the cards in his or her hand by picking a new card from a discard pile or the undealt stack of cards. If player keeps such new card he or she tosses a card from existing hand to discard pile in order to maintain a seven-card hand throughout the game. Players try to develop a hand in which every letter is either a word itself or part of a word. A seven-letter word wins and all other hands that use up all letters in combination of complete words are ranked based on longest word or words.

17 Claims, 2 Drawing Sheets

FIG. 6

English alphabet:

A, B, C, D, E, F, G, H, I, J, K, L, M, N, O, P, Q, R, S, T, U, V, W, X, Y, Z

Vowels: A, E, I, O, U

FIG. 7

Spanish alphabet:

A, B, C, CH, D, E, F, G, H, I, J, K, L, LL, M, N, N, O, P, Q, RR, S, T, U, V, W, X, Y, Z

Vowels: A, E, I, O, U

Vowels with accents: Á, É, Í, Ó, Ú

WORD CARD GAME

BACKGROUND—FIELD OF INVENTION

This invention relates to card games, specifically word card games.

BACKGROUND—DESCRIPTION OF PRIOR ART

Word forming games using individual letters of the alphabet are known in the prior art. "Scrabble" (trademark) is the most famous. In this game, players receive a number of tiles containing letters and point values. They attempt to use all of their tiles to make words which they place on a game board, each player building on the first and subsequent words that are formed by players so the result looks like a crossword puzzle. Players add up the points on each of the letter tiles they use in their words and they record the result. Players end up with a total of points for the game which they compare with each other's score. There are other word forming games that have features similar to those in Scrabble. Some of these games use playing cards instead of tiles and they do not use a game board.

Some word card games consist of a deck of cards and method of play, the cards of which contain a letter of the alphabet and point designation. Player attempts to use all of his or her cards to form a word or words before other players. They also add up the point value of letters in the words they make to determine a score for the game. Games currently on the market called "Letras" (trademark) and "Quiddler" (trademark) are examples of these. Both Letras and Quiddler include a method of play in which one game consists of several hands. In Letras, the dealer decides on the number of cards to be dealt in each of such hands, such number to be between three and eight. Hands are dealt and words formed until a player accumulates a certain predetermined number of points. In Quiddler, the number of cards dealt in each hand is fixed, with the first hand being three cards, the next four, and on up to a hand of ten cards. Then point scores are compared. Word card games including letters marked with numbers and steps of adding up points or deducting points are at a disadvantage if shoppers are looking for a fresh word card game that doesn't involve points and adding up or deducting points to determine a score. There is also a need for an alternative word card game in which one game doesn't consist of several hands.

U.S. Pat. No. 5,417,432 claims a basic deck of matched alphabet cards that don't include points and is targeted at young children's learning activities and games. Of five suggested games for such deck, four are for youngsters who are learning about the alphabet and how to form words. Steps of the fifth game include making words by putting down the appropriate letter cards face up on a surface and thereby allowing other players to add to or change the letters of such words. The first person to use up all his cards is the winner. This feature of putting down cards on a surface might not be attractive to shoppers who want a word card game that doesn't need a sizable amount of flat surface, or a game in which just any combination of words will win.

Some word card games use features and symbols of traditional cards. U.S. Pat. No. 4,333,656 claims a deck of cards which contain a letter of the alphabet, point designation, and suit markings of traditional playing cards (hearts, clubs, diamonds, spades), and also suggests games that can be played with the deck. The markings and similarities to traditional cards, while expanding the versatility of the deck may not be attractive to children or individuals who like word games but are neither familiar with traditional cards nor have an interest in them.

Known prior art therefore discloses and suggests word card games that, while possessing a common goal of forming words, suffer from the following disadvantages:

a) It includes cards marked both with letters of the alphabet and points, and combined game play includes steps of adding up and deducting such values to determine a score for game. There is a need for a new word card game in which cards do not include points and points are not a factor in the formation of words or determination of a score.

b) It includes steps of play in which one game consists of several different hands of cards and varying numbers of cards. There is a need for a word card game in which one game consists of one hand.

c) It includes cards marked with suit symbols of traditional cards. The symbols and games of traditional cards might not be attractive to shoppers who are looking for a word card game but have neither knowledge of nor interest in traditional playing cards.

d) It includes a deck including letters of the alphabet without point markings or traditional playing card suit symbols and suggests steps of a game that includes the spelling out of words on a flat surface and allowing other players to change or add to such words, with the first person to use up his or her cards the winner. This feature may be eliminated so that a sizable flat surface isn't needed for play and the first player to use up all his or her cards in any combination of words doesn't win a game.

SUMMARY

A deck of cards and method of play, in combination, comprising a word game that does not feature points, multiple hands, or the suit symbols of traditional playing cards, and in which players are dealt a number of cards containing letters of the alphabet which they use to form complete words within their dealt hands.

OBJECTS AND ADVANTAGES

Accordingly, several objects and advantages of the present invention are:

a) to provide a novel word card game that does not include points and does not include symbols or methods of traditional card games;

b) to provide a word card game that is about words only, and excludes formation of sets or sequences of letters;

c) to provide an alternative word card game that is stimulating enough to appeal to players at all levels together;

d) to provide a word card game that is amusing, easy to learn, and not on the market today;

e) to provide a novel word card game that uses only a deck of cards and is therefore compact, inexpensive to produce, easy to store, easy to pack for travel, and more available to all economic levels of the buying public;

f) to provide a word card game to be packaged and marketed with a distinctive name that signals its theme.

Further objects and advantages of my invention will become apparent from a consideration of the drawings and ensuing description.

DRAWING FIGURES—PREFERRED EMBODIMENT

FIG. 6 shows the letters of the English alphabet

DRAWING FIGURES—ALTERNATIVE EMBODIMENT (Spanish)

FIG. 7 shows the letters of the Spanish alphabet

DESCRIPTION OF INVENTION—PREFERRED EMBODIMENT

Figure 1:
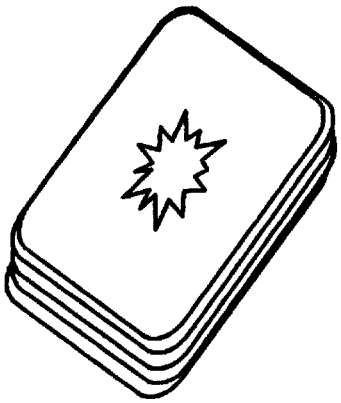
FIG. 1 shows a perspective of a deck of cards, face-side down

The Preferred Embodiment of my word card game consists of a deck of cards that contain letters of the English alphabet. FIG. 1 shows a perspective view of this deck of cards.

The deck includes 62 cards of the approximate size and shape of standard playing cards. This deck is ideal for a game with two to four players. However, up to six players can play as well. The length of each card is approximately 3½ inches and width is approximately 2 ½ inches. Since the game is suitable for adults together as well as others, there is not one large letter of the alphabet positioned in the middle of each card, as there might be to also facilitate activities for young children. The face side of each card contains two identical representations of a letter of the alphabet. These are positioned in opposite comers and sized for reading ease and so that no matter which way players hold the cards, one of the letters is visible in the top left hand comer of the card. To facilitate word formation, there are more cards marked with each vowel in the alphabet than marked with each consonant. However, distribution of vowels and consonants is straightforward and easy to remember so players do not have to consult a chart to find out how many there are of each letter. The design on the face of each card is distinctive and consists of a circular design within an oblong shape, the sides of which parallel the sides of the cards. The back of each card will contain a design that is similar to that on the face side.

Figure 3:
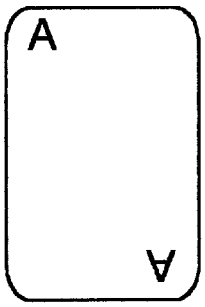
FIG. 3 is an example of one side of a vowel card

FIG. 3 is an example of one side of a card containing one of the five vowels in the alphabet. The deck contains four cards for each of the five vowels, for a total of 20 cards.

Figure 4:
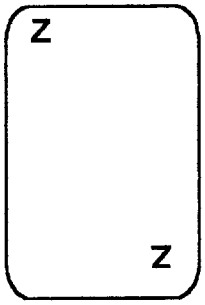
FIG. 4 shows an example of one side of consonant card

FIG. 4 is an example of a card containing one of the 21 consonants in the alphabet. The deck contains two cards for each of the 21 consonants, for a total of 42 cards.

Figure 5:
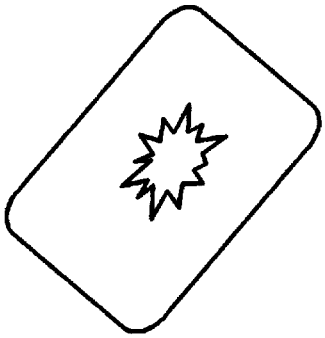
FIG. 5 shows the reverse side of all of the cards

FIG. 5 is one example of the reverse side of each card in the deck. The reverse side of each card is identical and does not reveal what is on the other side.

FIG. 6 shows the letters of the English alphabet.

Figure 2:
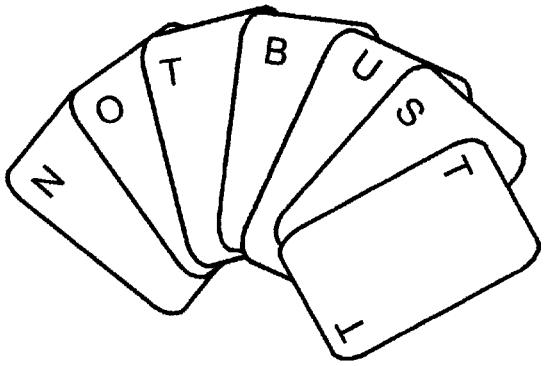
FIG. 2 illustrates the hand-style method of holding the cards

During game play, cards are held "hand" or "fan" style by each player, so that each player's hand is private during game play. FIG. 2 is an illustration of this card holding style.

Operation of Invention—Preferred Embodiment

In the Preferred Embodiment, players are dealt a hand of seven cards, each card containing a letter of the alphabet. Players maintain a seven-card hand throughout game but have opportunity to change the cards in such hand by gaining new cards and tossing cards they don't want during game play.

The goal of players is to use all of their cards to form one word, and if they can't form one long word, they must strive to form a combination of the longest words they can while using up all the letters in their hands. Points are not a factor in the formation of words. Even though there is a dual goal, only the player who forms one word with his or her hand triggers game end and a show of hands. The game doesn't end as soon as one player has used up all his or her cards in just any combination of words that are less than seven letters each with that player forcing other players to reveal their hands. Players together may also trigger a show of hands if no one player has formed a seven-letter word after a particular period of play as described below.

While the hand that forms one word, and therefore the longest word, is the winning hand, the other revealed hands that use all letters in a combination of shorter words achieve ranking based on the longest word or words in such combinations. Hands that contain stray letters are unranked or "bust". The goal of the game is therefore two-fold. One is to use up all letters in one word. The second is to avoid going bust by making sure that if you can't make one long word, you do make a combination of shorter words using all your letters. Players need to balance these two interests. A logical name for my word game both points to a goal or destination and describes its concept, and might be "All Words or Bust".

This standard of game performance or success accommodates players at many different levels. Those who don't form seven-letter words can still form a combination of shorter words and avoid going bust. This is a fun alternative to ending a game with a score or number that is lower than somebody else's score or number. There is a good chance, for example, that younger players who are part of a game that includes adults, will not go bust even though they don't form the seven letter word. They also have the chance to win with a hand of two or more words because some adults might be more likely to risk sure combinations of short words in the hope of forming one long word. The game contains components of challenge, risk, and a chance for everybody to have fun. Every player has a good chance to avoid going bust. Not every player will easily form the seven-letter word. Children can beat adults. Adults playing with adults may have a longer, more intense game.

The ranking that is applied to hands that use all cards in either one word or a combination of words is based on word length. Players do not need to add up points or consider points. They show their hands and state their combinations, e.g. "two words, 6-1" or "three words, 3-3-1". Ranking is simple and done by first counting words and then counting the letters in such words. In the event the first word in each of the hands of more than one ranking player is the same length, ranking is based on length of second longest word in their combinations, and so on (e.g. 3-3-1 beats 3-2-1). Players easily work out this logical system without having to consult any sort of written description. However, I will give the possible word combinations in order of rank directly below. Players with hands containing the same number of words of the same length are tied.

| One Word | Two word combo | Three word combo | Four word combo | Five, six, and seven word combo |
|---|---|---|---|---|
| 7 | 6-1 | 5-1-1 | 4-1-1-1 | 3-1-1-1-1 |
| | 5-2 | 4-2-1 | 3-2-1-1 | 2-2-1-1-1 |

-continued

| One Word | Two word combo | Three word combo | Four word combo | Five, six, and seven word combo |
|---|---|---|---|---|
| | 4-3 | 3-3-1<br>3-2-2 | 2-2-2-1 | 2-1-1-1-1-1<br>1-1-1-1-1-1-1 |

Play consists of the following (using one gender for simplicity). To begin, the deck of cards 6, 10, 12 is shuffled. A player is selected to be dealer and player order is determined. Dealer deals seven cards to each player. The dealer puts the remaining cards in stack form in a position that is central to all players. Players gather up their cards in hand or fan style 8 so the letters are facing them and other players can't see the letters they have. They keep their cards hand style throughout the game.

It is optional for the top card of the central stack to be turned over, revealed, and to become the first card of a discard pile. If this is the case, the first player in the game decides whether he would like to have the card on the discard pile or would like to pick a card from the central stack. If the decision is to take the card that is on the discard pile, the player must toss one of the cards in his hand so as to always maintain a seven-card hand. The tossed card is thrown face-up to the discard pile. If the player prefers to pick from the central stack, he does so and decides whether to keep or toss. If the player keeps, he tosses one of the cards in his hand so as to always maintains a seven-card hand. If player doesn't keep the card from the central stack, he throws it face up to top of the discard pile.

This process is repeated player after player until a player declares a seven-letter word. If the central stack of cards is used and nobody has declared a seven-letter word, the stack of discarded cards is shuffled. This stack is then placed face down for use again in the same game by players as they continue to attempt to make the seven-letter words. This is repeated until somebody either declares a seven-letter word or players jointly decide to show and rank hands, as later described.

If, at game start, the top card of the central stack of cards isn't turned over, the process of picking and tossing cards is basically the same. The only difference is that the first player must select from central stack and the discard pile is created by the first tossed card in the game.

An example of a player's thought during a game of three players. Player X is dealt seven cards containing the letters "r, g, i, d p, g, o". He initially thinks of the word "prodigy" and realizes he only needs a "y" in order to make this seven-letter word. However, after a few plays, he doesn't get a "y". He decides to change strategy. He tentatively arranges his cards into "grip" and "dog" (4-3). He likes the idea of "grip" because it can be added to in a variety of ways. In turn, this player selects an "e". He keeps the "e" and tosses the "g" and rearranges his cards into "gripe" and "do". This hand of 5-2 also beats his previous 4-3 hand.

The player is now thinking that if he picks an "i" or an "a", he can use his "d" to make "griped" and throw away his "o". Then he would have "griped" and either "i" or "a", giving him a six-letter word and a one-letter word (6-1), which would beat a five and two (5-2). There is still the possibility of "gripped" or "gripper", which are both seven-letter words. As play proceeds, the player realizes he might not easily get another "p". Then he notices that the other letter "p" in the deck is taken by another player. He starts to rethink his hand of "gripe" and "do". He wants a word that has a better potential for seven letters. He rearranges his hand to "pre-di-go". "Pre-di" are not words, but he will gamble on being able to use the letters "pre" in a seven-letter word. For example, he might pick a "c" and a "t" to make "predict". He might have to consider other seven-letter words beginning with pre, such as prevail or preview. The letters "pre" are good letters on which to build longer words, and he will gamble on doing so.

Bust hands are those that contain letters that are not part of words or are not words themselves. There are no restrictions on word length, and one-letter words such as "a" and "i" are acceptable. In my word card game, a hand with a six-letter word and an extra letter that is not in itself a word (i.e. "griped" and "q") will lose to a hand that contains, for example, a 5-letter word and a 2-letter word (5-2) or a four-letter word and three I -letter words (4-1-1 -1) or any hand for that matter that contains a combination of complete words of any length. A challenge is for a player who has, for example, a word of six letters and a word of one letter (6-1) to break up or spoil such six-letter word and complete word combination in order to form a new seven-letter word.

The game ends in two ways. One is when a player announces he has a seven-letter word and shows his hand. At that time, all other players show their hands and ranking will occur. Bust players are revealed. The game will also end in the event no player is able to create a seven-letter word with his hand in spite of the fact that the discard stack has been shuffled and reused three times. In this case, players will decide jointly to show their hands, ranking will occur, and bust players revealed.

It is optional in my game for both the player who announces a seven-letter word and the players who are ranked to be required to use the word or words they create in sentences that demonstrate use and the meaning of such word or words, regardless of the length of such words. They would do this by expressing such sentences to all players. This feature is useful in developing effective verbal skills and creativity, even when the words are common. It is a fun addition to the game and a good teaching and learning tool for everybody.

Description of Invention—Alternative Embodiment (Spanish)

The Alternative Embodiment consists of a deck of cards including letters of the Spanish alphabet. FIG. 7 shows these letters. The deck is constructed just as the deck in the Preferred Embodiment except as follows:

The deck includes 70 cards.

The deck includes two cards for each of the five vowels and two cards for each of the five vowels with accents, for a total of 20 cards.

The deck includes two cards for each of the 25 consonants, for a total of 50 cards.

Operation of Invention—Alternative Embodiment (Spanish)

The operation of the Alternative Embodiment is the same as that of the Preferred Embodiment.

Conclusions, Ramifications and Scope

Accordingly the reader will see that my proposed game provides:

a) a novel word card game that eliminates the consideration of points in the formation of words or determination of scores or game outcome;

b) a word card game that eliminates cards bearing traditional playing card suit symbols such as hearts, clubs, spades or diamonds, and eliminates traditional card terminology or steps of traditional card games applied to letters or words;

c) a word card game that eliminates multiple steps of prior word game play including all point-related activity;

d) a word card game that is totally word focused and excludes formation of sets or sequences of letters;

e) a word card game that provides a new standard of game performance and success and a new challenging strategy for game play;

f) a new word card game consisting only of a deck of cards that is substantial enough to be offered as a unique game with its own package and distinctive name;

g) a word card game that is amusing and offers the potential for surprising results in that younger players can play with older players and beat them;

While my above description contains many specificities, these should not be construed as limiting the scope of the invention, but as merely providing illustrations of some of the presently preferred embodiment of the invention. For example, lower or higher numbers of cards may be dealt to players and the length and ranking of longest words adjusted accordingly; the distribution of vowels and consonants in a deck can be changed to reflect more or less particular consonant cards or more or less particular vowel cards; a number of wild cards that can represent any letter of the alphabet can be included in the deck for optional use at player discretion; or the deck could be sold in a dual pack to increase proportionately the available letters and to facilitate a large number of players.

Accordingly, the scope of the invention should be determined not by the embodiment illustrated, but by the appended claims or their legal equivalents.

I claim:

1. In a word card game of the type comprising, a deck of cards including letters of the alphabet, wherein dealer deals the same number of cards to each player, forms a draw stack and a discard pile with remaining deck, and players in turn picking a new card from discard pile or draw stack and if keeping such new card tossing a card from existing hand face up to top of discard pile and attempting to form a word or words with such hand, the improvements in combination:

A) providing a deck of cards that do not include points or numeric indicia and do not include symbols of traditional playing cards;

B) players forming all cards within their hands into one word or a combination of words and using up all of said cards in such word or combination of words, whereby any other hand is bust and of no value;

C) players keeping said words within their hands as they are formed so nobody else can see them until hands are shown as herein described;

D) players maintaining original number of dealt cards until hands are shown as herein described;

E) those players forming one word using all of their cards, revealing said cards, and thereby forcing a show of all hands, F) players forming all cards of hand into a combination of words in event a different player forms said one-word trigger hand before them and they are forced to show their hands, or in the event all hands are otherwise shown, whereby in either event such players will not be caught with a hand that is bust or of no value;

G) players forming all cards of hand into a combination of the longest words they can using all of their cards, whereas such players attempt to rank higher than other players when such combination hands are shown;

H) determining from shown hands those hands containing the longest words within a set of complete words and ranking such hands based on longest word or words in such hands;

I) determining from shown hands the hands or hands that are bust or of no value, whereas players balance formation of one-word trigger hand and non-bust hand as they pick and toss cards without regard to points.

2. The game of claim 1 wherein said deck of cards comprises 62 cards and such deck includes four cards containing each of the five vowels and two cards containing each of the remaining 21 consonants of the alphabet.

3. The game of claim 2 wherein said number of cards dealt is seven.

4. The game of claim 3 wherein said ranking of word length is as follows:

7
6-1
5-2
4-3
5-1-1
4-2-1
3-3-1
3-2-2
4-1-1-1
3-2-1-1
2-2-2-1
3-1-1-1-1
2-2-1-1-1
2-1-1-1-1-1
1-1-1-1-1-1-1.

5. The game of claim 1 including the further step of

J) player who announces a seven-letter word, using such word in a sentence that demonstrates the word's use or meaning, prior to said showing of hands by all other players, and upon such player failing in consensus of all players, the game continuing and other players not revealing their hands until the same or a different player announces a seven-letter word and demonstrates its use as just described.

6. The game of claim 1 wherein said deck of cards includes letters of the Spanish alphabet.

7. A word card game of the type comprising cards including at least one card for each letter of the alphabet, wherein dealer deals hand of cards to each player, forms a draw stack and a discard pile from which players in turn pick and toss while attempting to form words with their hands, characterized by:

A) providing a deck of cards that do not include points or numeric indicia;

B) players maintaining same number of original dealt cards;

C) players forming the longest word or words they are able to form within their hands and using all cards in such word or words and avoiding a hand with cards that are not either words themselves or parts of words which hands are bust or of no value;

D) players keeping said words within their hands as they are formed so nobody else can see them until one player forming a one-word hand, revealing such hand, and thereby forcing all other players to show hands at one time;

E) players forming a hand containing a combination of the longest words possible while using up all cards in hand in event a different player forms a one-word hand before them and they are forced to show their hands or in event all players otherwise show hands, whereas such players are not bust and rank higher than other players when such combination hands are thereby shown;

F) determining from shown hands those hands containing the longest words within a hand of complete words and ranking such hands based on longest word or words in such hands;

G) determining from shown hands the hands or hands that are bust or of no value;

whereas players balance formation of one-word trigger hand and non-bust hand as they pick and toss cards without regard to points.

8. The game of claim 7 wherein said deck of cards comprises 62 cards and such deck includes four cards containing each of the five vowels and two cards containing each of the remaining 21 consonants of the alphabet.

9. The game of claim 8 wherein said number of cards dealt is seven.

10. The game of claim 9 wherein said ranking of word length is as follows:

7
6-1
5-2
4-3
5-1-1
4-2-1
3-3-1
3-2-2
4-1-1-1
3-2-1-1
2-2-2-1
3-1-1-1-1
2-2-1-1-1
2-1-1-1-1-1
1-1-1-1-1-1-1.

11. The game of claim 7 including the further step of

H) the player who announces a seven-letter word, using such word in a sentence that demonstrates the word's use or meaning, prior to said showing of hands by all other players, and upon such player failing in consensus of all players, the game continuing and other players not revealing their hands until the same or a different player announces a seven-letter word and demonstrates its use as just described.

12. The game of claim 7 further including at least one card that is not marked with a particular letter of the alphabet and is called a wild card and can be used to represent any letter of the alphabet.

13. The game of claim 7 wherein said deck of cards includes letters of the Spanish alphabet.

14. A (n improved) method of play of a word card game of the type comprising cards including letters of the alphabet wherein dealer deals a hand of cards to each player, forms a draw stack and discard pile with remaining deck, and players in turn draw and discard cards as they form words with such cards, comprising in combination:

A) players forming the longest word or words of any length they are able to form within their hands and using all cards in such word or words and avoiding a hand with cards that are not either words themselves or parts of words which hands are bust or of no value;

B) players maintaining same number of original dealt cards;

C) players keeping said words within their hands as they are formed so nobody else can see them until one player forming a one-word hand, revealing such hand, and thereby forcing all other players to show hands at one time;

D) players forming a hand containing a combination of the longest words possible while using up all cards in hand in event a different player forms a one-word hand before them and they are forced to show their hands or in event all players otherwise show hands, whereas such players are not bust and rank higher than other players when such combination hands are thereby shown;

E) determining from shown hands those hands containing the longest words within a set of complete words and ranking such hands based on longest word or words in such hands;

F) determining from shown hands the hands or hands that are bust or of no value;

whereas an improved method is provided that eliminates all steps related to points and in which players complete with each other as they balance formation of one-word trigger hand and non-bust hand.

15. The game of claim 14 wherein said deck contains a larger number of each of the cards marked with vowels than of at least some of each of the cards marked with consonants.

16. The game of claim 14 wherein said deck of cards includes letters of the Spanish alphabet.

17. The game of claim 14 wherein said ranking of word length is as follows:

7
6-1
5-2
4-3
5-1-1
4-2-1
3-3-1
3-2-2
4-1-1-1
3-2-1-1
2-2-2-1
3-1-1-1-1
2-2-1-1-1
2-1-1-1-1-1
1-1-1-1-1-1-1.

* * * * *